US006532846B2

(12) United States Patent
Lin

(10) Patent No.: US 6,532,846 B2
(45) Date of Patent: Mar. 18, 2003

(54) TOOL HAVING A HANDLE THAT MAY ADJUST THE ARM OF FORCE OF THE TOOL

(75) Inventor: Chorng-Jiang Lin, Taichung (TW)

(73) Assignee: Chuck Chang, Taichung Hsien (TW)

( * ) Notice: Subject to any disclaimer, the term of this patent is extended or adjusted under 35 U.S.C. 154(b) by 0 days.

(21) Appl. No.: 09/974,841

(22) Filed: Oct. 12, 2001

(65) Prior Publication Data

US 2002/0017172 A1 Feb. 14, 2002

Related U.S. Application Data

(63) Continuation-in-part of application No. 09/512,072, filed on Feb. 24, 2000, now Pat. No. 6,370,990.

(51) Int. Cl.[7] ..... B25B 23/16

(52) U.S. Cl. ..... 81/177.2; 81/185.2; 403/109.3; 403/377

(58) Field of Search ..... 81/177.1, 177.2, 81/177.85, 185.2, 184, 180.1; 16/405, 429; 403/109.1, 109.2, 109.3, 107, 377

(56) References Cited

U.S. PATENT DOCUMENTS

| | | | | | |
|---|---|---|---|---|---|
| 3,227,015 | A | * | 1/1966 | Tremblay | 81/177.2 |
| 5,193,419 | A | * | 3/1993 | Lee | 81/177.2 |
| 5,911,798 | A | * | 6/1999 | Arnold | 81/177.2 |
| 6,092,442 | A | * | 7/2000 | Macor | 81/177.1 |

* cited by examiner

*Primary Examiner*—D. S. Meislin
(74) *Attorney, Agent, or Firm*—Rosenberg, Klein & Lee

(57) ABSTRACT

A tool includes a shank, a handle slidably mounted on the shank and encompassing an outer periphery of the shank, thereby forming a closed state, and a positioning structure mounted between the shank and the handle for positioning the handle on the shank. The positioning structure includes at least one positioning portion formed on the shank, and at least one positioning body formed on the body. The positioning body may be locked and positioned on the positioning portion when the handle is compressed, thereby positioning the handle on the shank.

12 Claims, 6 Drawing Sheets

TOOL HAVING A HANDLE THAT MAY ADJUST THE ARM OF FORCE OF THE TOOL

CROSS-REFERENCES TO RELATED APPLICATIONS

The present invention is a continuation-in-part (C.I.P.) application of the U.S. Ser. No. 09/512,072, filed on Feb. 24, 2000 now U.S. Pat. No. 6,370,990.

BACKGROUND OF THE INVENTION

1. Field of the Invention

The present invention relates to a tool having a handle that may adjust the arm of force of the tool, and more particularly to a tool having a handle that may adjust the arm of force of the tool, wherein the handle may be rigidly and stably positioned on the shank temporarily, so that the handle cannot slide on the shank, thereby providing a positioning effect.

2. Description of the Related Art

The closest prior arts of which the applicant is aware is disclosed in U.S. Pat. Nos. 5,396,820; 5,099,724; 4,409,866. The above references all disclose a handle tool including a shank, and a handle slidably mounted on the shank, so as to adjust the arm of force of the hand tool.

SUMMARY OF THE INVENTION

The primary objective of the present invention is to provide a tool having a handle that may adjust the arm of force of the tool, wherein when the user's hand exerts a compressing force on the handle, the positioning body of the positioning structure may be moved inward to be inserted into and locked in one of the positioning portions of the positioning structure, thereby rigidly and stably positioning the handle on the shank, so that the handle cannot slide on the shank, thereby providing a positioning effect, so as to adjust the arm of force of the tool successively.

In accordance with the present invention, there is provided a tool having a handle that may adjust the arm of force of the tool, comprising:

a shank;

a handle slidably mounted on the shank, the handle encompassing an outer periphery of the shank, and forming a closed structure; and a positioning structure mounted between the shank and the handle for positioning the handle on the shank; wherein:

the positioning structure includes at least one positioning portion formed on the shank, and at least one positioning body formed on the body, the at least one positioning body may be locked and positioned on the at least one positioning portion, thereby positioning the handle on the shank.

Further benefits and advantages of the present invention will become apparent after a careful reading of the detailed description with appropriate reference to the accompanying drawings.

DETAILED DESCRIPTION OF THE INVENTION

Figure 1:
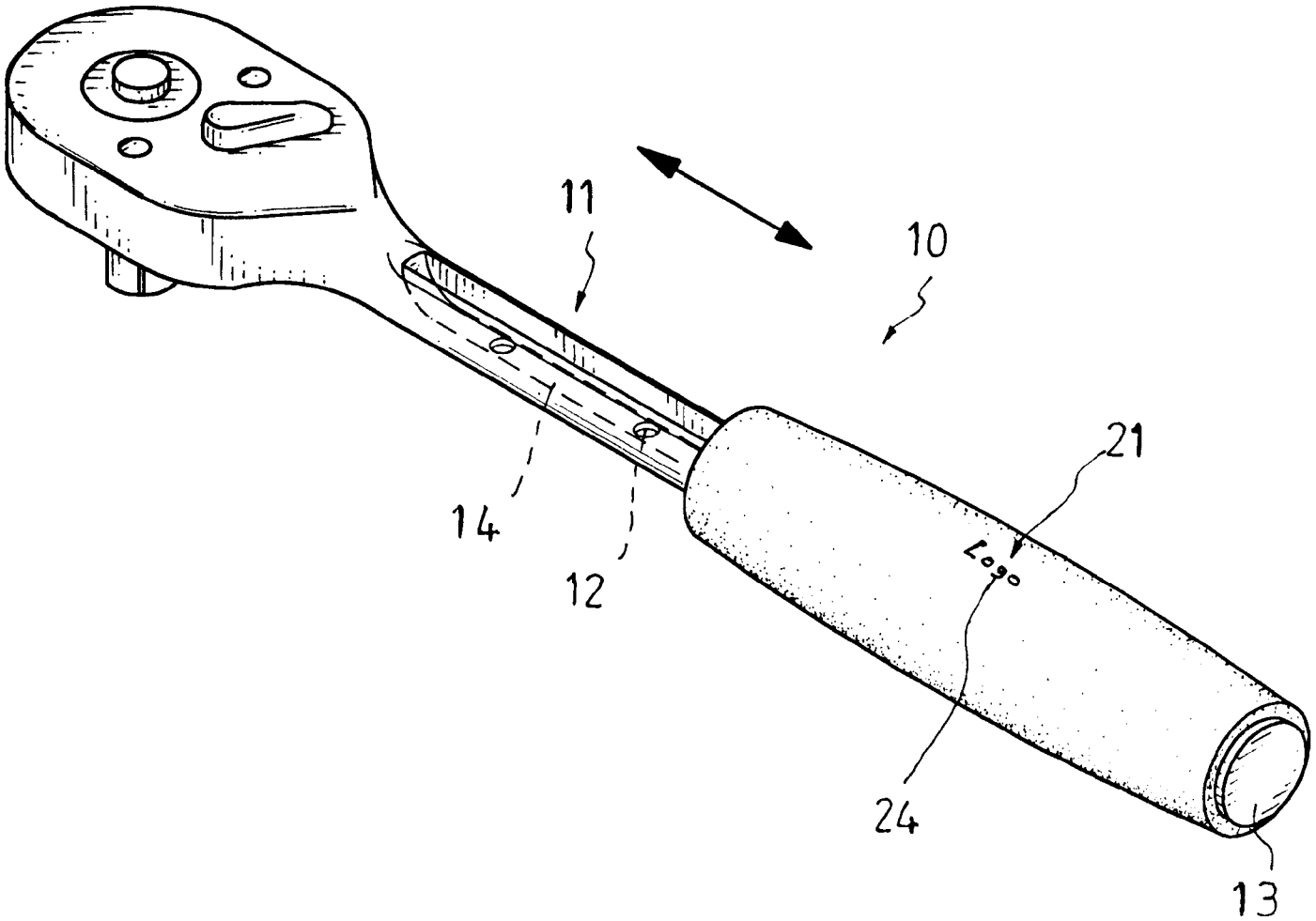
FIG. 1 is a perspective view of a tool having a handle that may adjust the arm of force of the tool in accordance with a first embodiment of the present invention.
Figure 2:
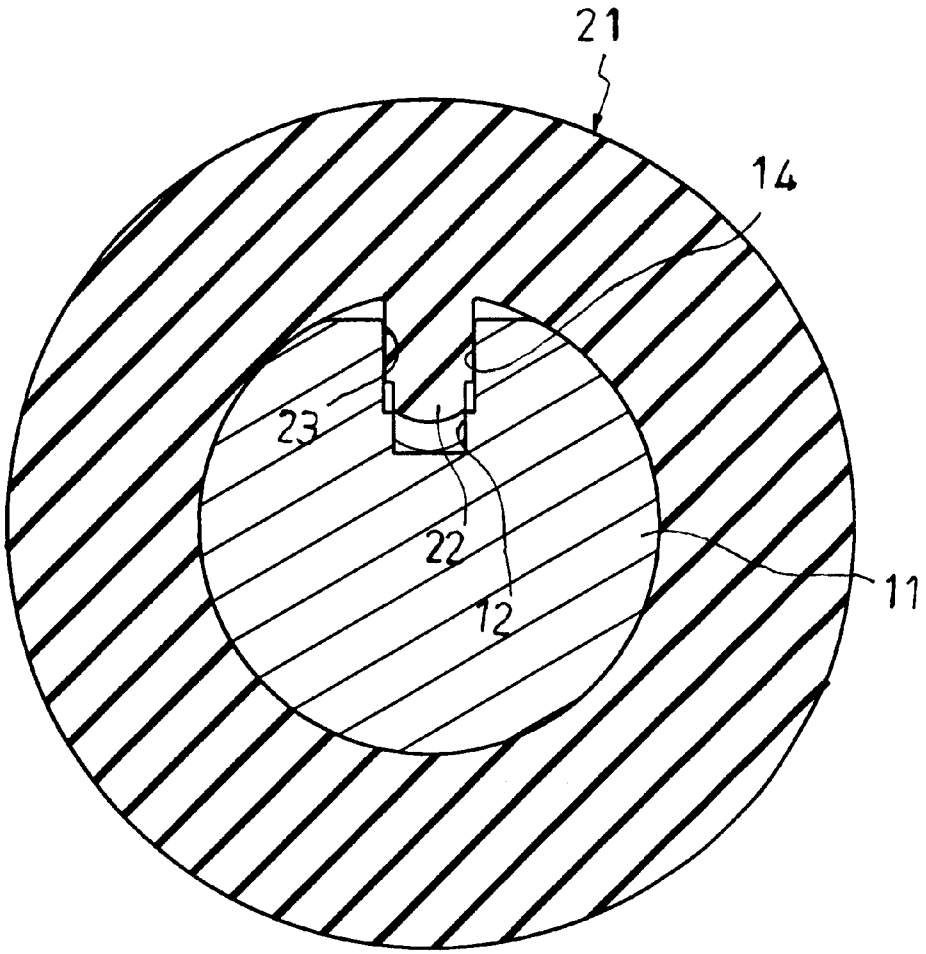
FIG. 2 is a side plan cross-sectional view of the tool having a handle that may adjust the arm of force of the tool as shown in FIG. 1.

Referring to the drawings and initially to FIGS. 1 and 2, a tool 10 in accordance with a first embodiment of the present invention comprises a cylindrical shank 11, a cylindrical handle 21 slidably mounted on the shank 11, and a positioning structure mounted between the shank 11 and the handle 21 for positioning the handle 21 on the shank 11.

The shank 11 is axially formed with an anti-rotation portion 14, preferably an elongated guide slot 14. The positioning structure includes a plurality of positioning portions 12, preferably a plurality of positioning holes 12, that are formed in the anti-rotation portion 14 of the shank 11. The shank 11 has a distal end provided with or integrally formed with an enlarged stop 13 for stopping movement of the handle 21. The enlarged stop 13 may be secured on the shank 11 in a screwing manner, thereby facilitating detachment.

The handle 21 made of an elastic material encompasses the outer periphery of the shank 11, and forms a closed structure. Thus, when the user's hand holds the soft handle 21, the user's hand will not directly touch the shank 11 in the handle 21, thereby preventing the shank 11 from hurting the user's hand.

An indication portion 24 is formed on an outer wall of the handle 21 for providing an indication or advertisement function.

An anti-rotation portion 23, preferably a slide 23, is formed in and protruded inward from an inner wall of the handle 21, and is slidably mounted in the anti-rotation portion 14 of the shank 11, so that the handle 21 may slide on the shank 11. The positioning structure includes a positioning body 22, preferably a positioning knob 22, that is integrally formed on a distal end of the anti-rotation portion 23 of the handle 21.

Before the user's hand exerts a compressing force on the outer wall of the handle 21, the positioning body 22 of the positioning structure does not contact the positioning portion 12 of the positioning structure, so that the handle 21 may slide on the shank 11. The anti-rotation portion 23 of the handle 21 may co-operate with the anti-rotation portion 14 of the shank 11, thereby preventing the handle 21 from rotating relative to the shank 11.

When the user's hand exerts a compressing force on the outer wall of the handle 21, the handle 21 is compressed inward, so that the positioning body 22 of the positioning structure may be moved inward to be inserted into and locked in one of the positioning portions 12 of the positioning structure, thereby rigidly and stably positioning the handle 21 on the shank 11, so that the handle 21 cannot slide on the shank 11, thereby providing a positioning effect.

Thus, when the user's hand exerts a compressing force on the outer wall of the handle 21, the handle 21 is slightly deformed due to the force, so that a friction of a large area produces between the inner wall of the handle 21 and the outer wall of the shank 11, thereby efficiently enhancing the holding and positioning effect.

When the compressing force of the user's hand exerted on the outer wall of the handle 21 is removed, the handle 21 is expanded outward due to its elasticity, whereby the positioning body 22 of the positioning structure may be moved outward to detach from the positioning portion 12 of the positioning structure, so that the handle 21 may slide on the shank 11.

Figure 3:
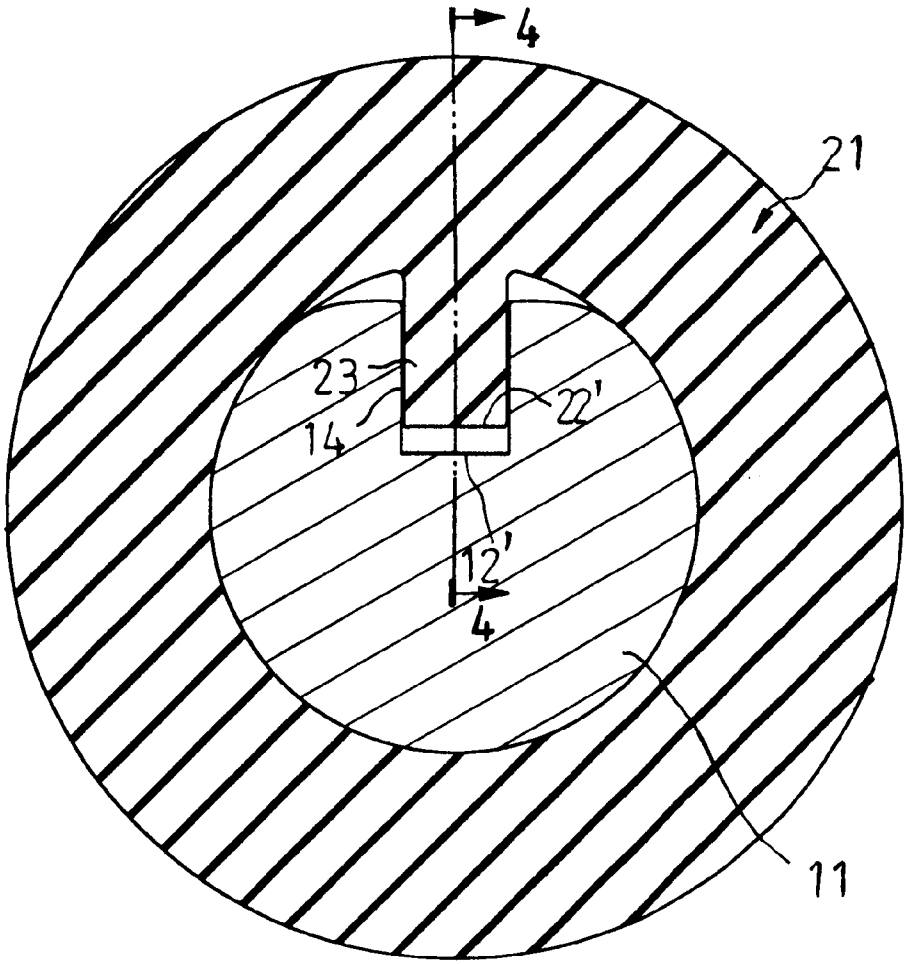
FIG. 3 is a side plan cross-sectional view of a tool having a handle that may adjust the arm of force of the tool in accordance with a second embodiment of the present invention.
Figure 4:
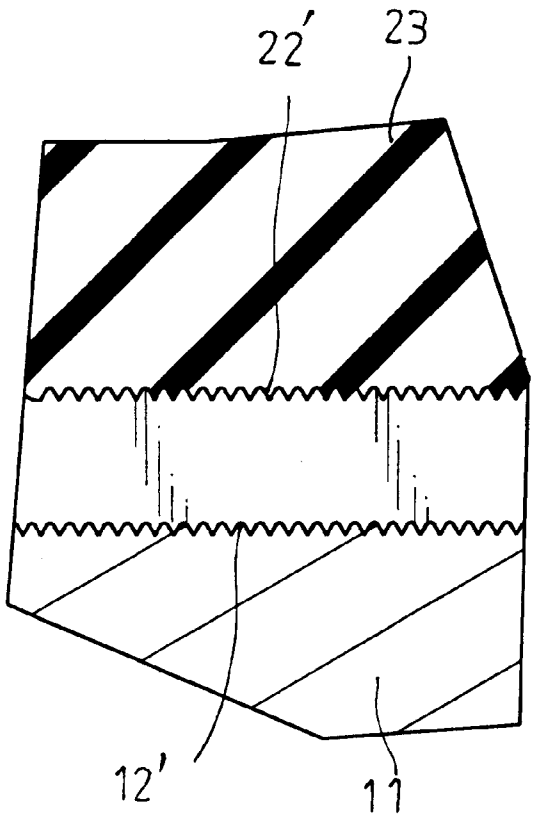
FIG. 4 is a cross-sectional view of the tool having a handle that may adjust the arm of force of the tool taken along line 4—4 as shown in FIG. 3.

Referring to FIGS. 3 and 4, in accordance with a second embodiment of the present invention, the positioning structure includes a positioning portion 12', preferably a first serrated face 12', that is formed on the anti-rotation portion 14 of the shank 11, and a positioning body 22', preferably a second serrated face 22', that is integrally formed on a distal end of the anti-rotation portion 23 of the handle 21. When the first serrated face 12' is moved inward to touch the second serrated face 22', the first serrated face 12' may engage the second serrated face 22' to provide a locking effect, so that the handle 21 may be positioned on the shank 11.

Figure 5:
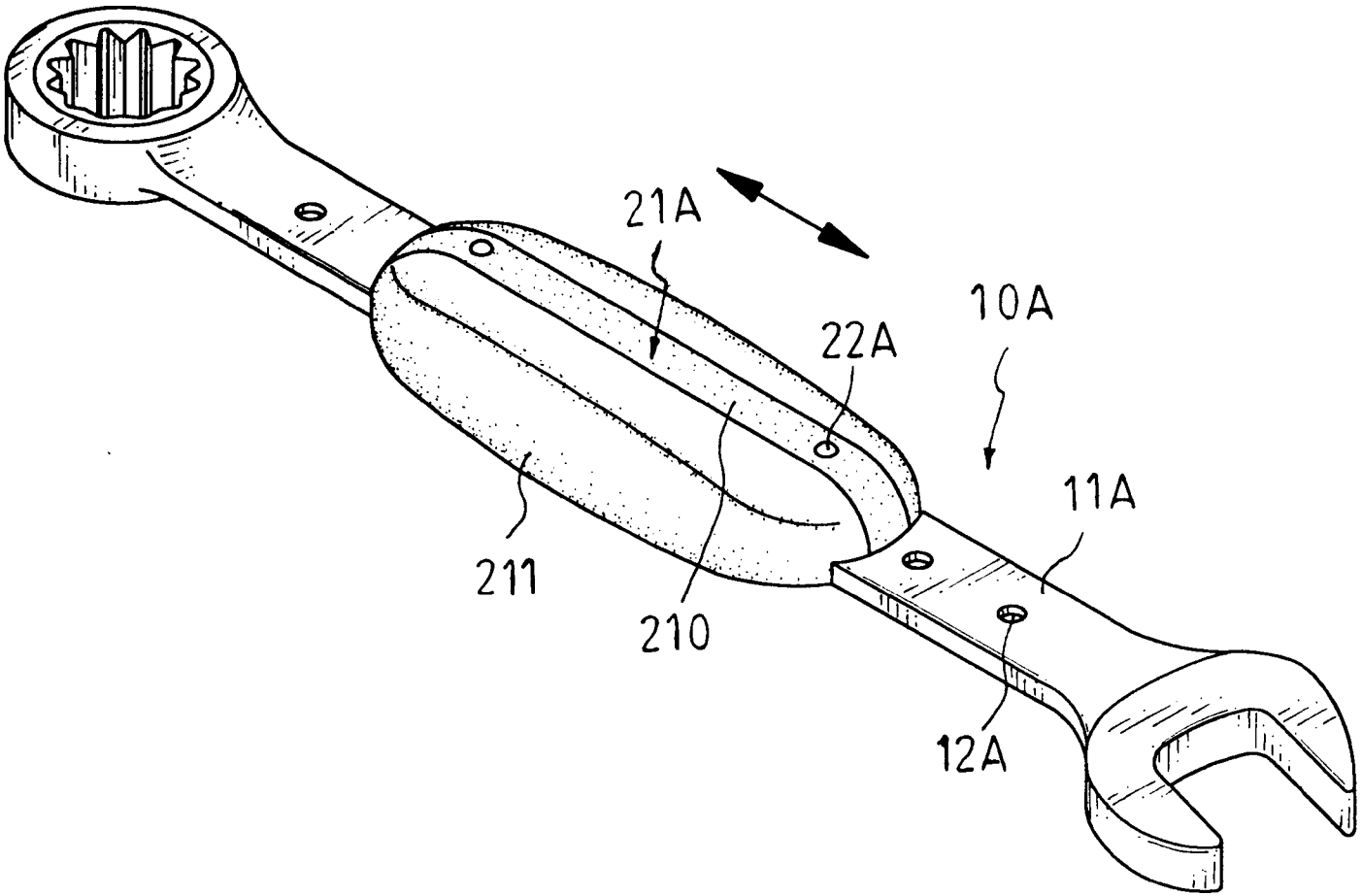
FIG. 5 is a perspective view of a tool having a handle that may adjust the arm of force of the tool in accordance with a third embodiment of the present invention.
Figure 6:
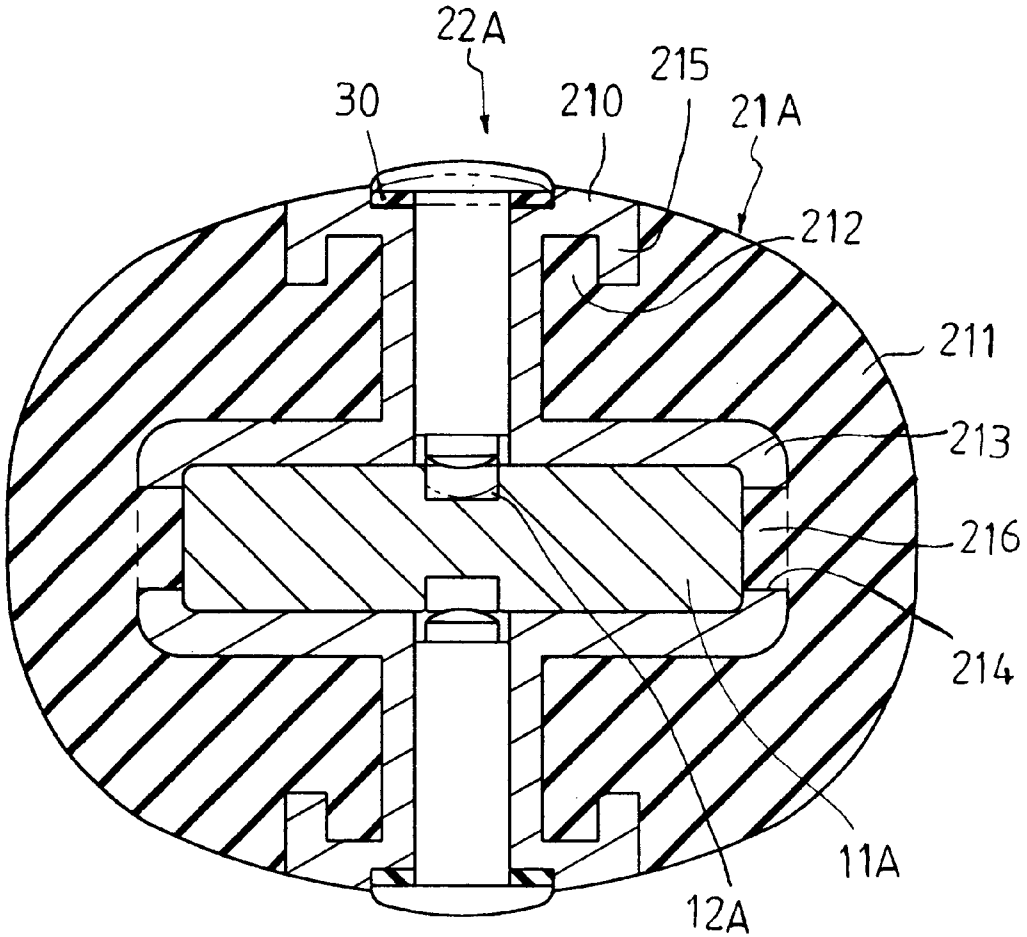
FIG. 6 is a side plan cross-sectional view of the tool having a handle that may adjust the arm of force of the tool as shown in FIG. 5.

Referring to FIGS. 5 and 6, a tool 10A in accordance with a third embodiment of the present invention comprises a flat shank 11A, an oblong handle 21A slidably mounted on the shank 11A, and a positioning structure mounted between the shank 11A and the handle 21A for positioning the handle 21A on the shank 11A.

The positioning structure includes a plurality of positioning portions 12A, preferably a plurality of positioning holes 12A, that are formed in the shank 11A.

The handle 21A consists of a housing 210 slidably mounted on the shank 11A, and two casings 211 each secured on the housing 210 in a snapping manner. The housing 210 and the two casings 211 may be made of an elastic material.

The housing 210 is formed with an enclosure 213 encompassing the outer periphery of the shank 11A and forming a closed structure. Thus, when the user's hand holds the handle 21A, the user's hand will not directly touch the shank 11A in the handle 21A, thereby preventing the shank 11A from hurting the user's hand. The enclosure 213 of the housing 210 is formed with two passages 214. The enclosure 213 of the housing 210 is preferably made of rigid material, thereby preventing the handle 21A from rotating relative to the shank 11A. The housing 210 is formed with multiple hooks 215.

Each of the two casings 211 encompasses the housing 210, and is formed with two hooks 212 secured with the hooks 215 of the housing 210, so that each of the two casings 211 may be locked and secured on the housing 210 in a snapping manner. Each of the two casings 211 has an inner wall formed with two lugs 216 each inserted into the passage 214 of the enclosure 213 of the housing 210 to press the outer wall of the shank 11A, thereby providing an anti-skid effect.

The positioning structure includes at least one positioning body 22A, preferably a positioning plug 22A, that is forced into the housing 210 of the handle 21A in a close fit manner. An elastic member 30 is mounted on the positioning body 22A, and is rested on the housing 210 of the handle 21A, so that the positioning body 22A of the positioning structure does not contact the positioning portion 12A of the positioning structure before the user's hand exerts a compressing force on the outer wall of the handle 21A, so that the handle 21A may slide on the shank 11A.

When the user's hand exerts a compressing force on the handle 21A, the handle 21A is compressed inward, so that the distal end of the positioning body 22A of the positioning structure may be moved inward to be inserted into and locked in one of the positioning portions 12A of the positioning structure, thereby rigidly and stably positioning the handle 21A on the shank 11A, so that the handle 21A cannot slide on the shank 11A, thereby providing a positioning effect.

Thus, when the user's hand exerts a compressing force on the outer wall of the handle 21A, the handle 21A is slightly deformed due to the force, so that a friction of a large area produces between the inner wall of the enclosure 213 of the handle 21A and the outer wall of the shank 11A, thereby efficiently enhancing the holding and positioning effect.

When the compressing force of the user's hand exerted on the handle 21A is removed, the handle 21A is expanded outward by the restoring force of the elastic member 30, whereby the positioning body 22A of the positioning structure may be moved outward to detach from the positioning portion 12A of the positioning structure, so that the handle 21A may slide on the shank 11A.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tool comprising:

a shank;

a handle made of an elastic material slidably mounted on the shank, the handle encompassing an outer periphery of the shank, and forming a closed structure; and a positioning structure mounted between the shank and the handle for positioning the handle on the shank; wherein:

the handle has two opened ends, so that the handle is slidable on the shank freely; and the positioning structure includes at least one positioning portion integrally formed on the shank, and at least one positioning body integrally formed on the handle, the at least one positioning body is lockable on the at least one positioning portion when the handle is compressed on the outer periphery of the shank, thereby positioning the handle on the shank.

2. The tool in accordance with claim 1, wherein the positioning portion of the positioning structure includes multiple positioning holes formed in the shank, and the positioning body of the positioning structure includes a positioning knob that is integrally formed on an inner wall of the handle and is insertable into one of the positioning holes.

3. The tool in accordance with claim 1, wherein the shank is axially formed with a first anti-rotation portion, and a second anti-rotation portion is formed on an inner wall of the handle, and is slidably mounted in the first anti-rotation portion of the shank, so that the handle is slidable on the shank without rotation.

4. The tool in accordance with claim 3, wherein the first anti-rotation portion of the shank is an elongated guide slot, and the second anti-rotation portion of the handle is a slide slidably mounted in the guide slot of the shank, so that the handle is slidable on the shank without rotation.

5. The tool in accordance with claim 1, wherein the shank has a distal end provided with an enlarged stop for stopping movement of the handle so that the handle is slidable on the shank freely without extending outward from the shank.

6. The tool in accordance with claim 1, further comprising an indication portion formed on an outer wall of the handle for providing an indication function.

7. The tool having a handle that may adjust the arm of force of the tool in accordance with claim 1, wherein the positioning portion of the positioning structure is a first serrated face, and the positioning body of the positioning structure is a second serrated face that may engage the first serrated face to provide a locking effect, so that the handle may be positioned on the shank.

8. The tool having a handle that may adjust the arm of force of the tool in accordance with claim 1, wherein the handle consists of a housing slidably mounted on the shank, and two casings each secured on the housing, the positioning portion includes a plurality of positioning holes formed in the shank, and the at least one positioning body is a positioning plug that is forced into the housing of the handle in a close fit manner, and the positioning plug may be inserted into one of the positioning holes.

9. The tool having a handle that may adjust the arm of force of the tool in accordance with claim 8, wherein the housing of the handle is formed with an enclosure encompassing an outer periphery of the shank and forming a closed structure, and the enclosure is slidably mounted on the shank.

10. The tool having a handle that may adjust the arm of force of the tool in accordance with claim 9, wherein the enclosure of the housing is formed with two passages, and each of the two casings has an inner wall formed with two lugs each inserted into each of the passages of the enclosure of the housing to press the outer wall of the shank, thereby providing an anti-skid effect.

11. The tool having a handle that may adjust the arm of force of the tool in accordance with claim 8, wherein the housing is formed with multiple hooks, and each of the two casings encompasses the housing, and is formed with two hooks secured with the hooks of the housing, so that each of the two casings may be locked and secured on the housing.

12. The tool having a handle that may adjust the arm of force of the tool in accordance with claim 8, further comprising an elastic member mounted on the positioning body, and is rested on the housing of the handle.

* * * * *